US005631546A

United States Patent [19]

Heinke

[11] Patent Number: 5,631,546

[45] Date of Patent: May 20, 1997

[54] POWER SUPPLY FOR GENERATING AT LEAST TWO REGULATED INTERDEPENDENT SUPPLY VOLTAGES

[75] Inventor: Friedhelm Heinke, Heroldsberg, Germany

[73] Assignee: U.S. Philips Corporation, New York, N.Y.

[21] Appl. No.: 499,885

[22] Filed: Jul. 11, 1995

[30] Foreign Application Priority Data

Jul. 14, 1994 [DE] Germany ..... 44 24 800.8

[51] Int. Cl.[6] ..... G05F 1/577

[52] U.S. Cl. ..... 323/267; 363/21

[58] Field of Search ..... 323/267, 268, 323/269; 363/21, 23, 25; 307/31, 32

[56] References Cited

U.S. PATENT DOCUMENTS

| | | | |
|---|---|---|---|
| 4,449,173 | 5/1984 | Nishino et al. | 363/21 |
| 4,660,136 | 4/1987 | Montorefano | 323/267 |
| 4,677,534 | 6/1987 | Okochi | 363/21 |
| 4,935,858 | 6/1990 | Panicali | 323/267 |
| 5,707,294 | 12/1991 | Nochi | 323/267 |

*Primary Examiner*—Matthew V. Nguyen
*Attorney, Agent, or Firm*—Bernard Franzblau

[57] ABSTRACT

A circuit arrangement for generating at least two interdependent supply voltages from an input voltage includes a first control stage for controlling the actual value of a first one (Ua1) of the supply voltages to a first nominal value which is adjustable between a first upper and a first lower tolerance limit. At least one further control stage controls the actual value of each further one of the supply voltages (Ua2, . . . , Uan) to a further nominal value, which is preferably adjustable within a range between each time a further upper and a further lower tolerance limit, by varying the first nominal value in the range between the first upper and the first lower tolerance limit in response to control signals obtained by a comparison performed between the actual values of the further supply voltages (Ua2, . . . , Uan) and the associated further nominal values in the associated control stages. This simplified circuit arrangement improves the accuracy of the supply voltages under load conditions.

14 Claims, 3 Drawing Sheets

POWER SUPPLY FOR GENERATING AT LEAST TWO REGULATED INTERDEPENDENT SUPPLY VOLTAGES

BACKGROUND OF THE INVENTION

This invention relates to a circuit arrangement for generating at least two interdependent supply voltages from an input voltage. Preferably, such interdependent supply voltages can be derived in a clocked power supply with a plurality of output voltages which are generated simultaneously by means of a converter. However, the invention also relates to any other type of power supply in which a plurality of interdependent supply voltages, for example, a plurality of supply voltages with a given ratio of the no-load voltages as for example across a plurality of secondary windings of a transformer, are derived from a common input voltage.

In such circuit arrangements one of the supply voltages can be controlled dependent upon the load to which it is connected, so as to influence the power supplied by means of the supply voltage in a load-dependent manner. As a result of this, the dependent other supply voltages will vary accordingly when the first-mentioned supply voltage is loaded. However, such a variation is undesirable.

In order to eliminate the influence of the load-dependent control of the first supply voltage on the dependent other supply voltage a separate control for each of the dependent other supply voltages may be provided, which serves to compensate for, on the one hand, the fluctuations caused by the load of the first supply voltage and, as the case may be, also of the dependent other supply voltages and, on the other hand, also the fluctuations of the dependent supply voltage caused by its own load. However, such a control, which is applied separately for each of the supply voltages, is very intricate for the mere reason that for each supply voltage a separate control loop is required and the power in the circuit powered by this supply voltage should be influenced by parts with a corresponding power rating. These parts alone already constitute a substantial part of the equipment. In addition, the control range of the individual control of each separate supply voltage is limited by the interdependence of the supply voltages. The control should compensate for the influence of the supply voltages on one another and for their own load dependence. This limits the accuracy and the control range of such control means in an undesirable manner. Moreover, the overall efficiency of a power supply of this construction deteriorates.

Another possibility could be to provide pre-loads for the individual interdependent supply voltages, enabling the dependent supply voltages to be adapted to the load of the regulated supply voltage. Apart from the substantial number of circuit elements required for this, it gives rise to very high losses, particularly in certain operating points, thereby drastically reducing the overall efficiency of the power supply.

SUMMARY OF THE INVENTION

It is an object of the invention to provide a circuit arrangement of the type defined in the opening sentence, by means of which at least two interdependent supply voltages can be generated, which supply voltages can be sustained within given tolerance limits even in the case of different loads and with a minimal number of circuit elements, and with low losses.

According to the invention this object is achieved in that a circuit arrangement for generating at least two interdependent supply voltages from an input voltage comprises a first control stage for controlling the actual value of a first one of the supply voltages to a first nominal value, which is adjustable between a first upper and a first lower tolerance limit, and at least one further control stage for controlling the actual value of each further one of the supply voltages to a further nominal value, which is preferably adjustable within a range between each time a further upper and a further lower tolerance limit, by varying the first nominal value in the range between the first upper and the first lower tolerance limit in response to control signals obtained by comparison between the actual values of the further supply voltages and the associated further nominal values in the associated control stages.

In accordance with the invention the first one of the supply voltages is thus controlled in a manner known per se, i.e. the associated first control stage controls the actual value of the first supply voltage to track the associated first nominal value. However, in accordance with the invention this first nominal value is adjustable in a given range between the first lower tolerance limit and the first upper tolerance limit. Adjustment of the first nominal value is effected by one or more control signals supplied by the further control stages, which are each associated with one of the further supply voltages. Each of the further control stages controls the actual value of the associated further supply voltage to the further nominal value associated with this supply voltage. However, this control is not effected by directly influencing the associated further supply voltage but by influencing the first nominal value of the first supply voltage, upon which the first control stage adapts the actual value of the first supply voltage to this changed first nominal value and thereby, through the interdependence of the supply voltages, also brings about the desired change of the actual value of the further supply voltage to be controlled. The tolerance limits for the individual nominal values impose such limitations on the described control processes that ultimately the actual values of all the supply voltages are controlled within the given ranges between the associated upper and lower tolerance limit. In this way not only the first one but all the supply voltages are controlled with the required accuracy.

Apart from a better accuracy of the interdependent supply voltages the invention also provides a substantial reduction of the number of circuit elements. In fact, only one part having a suitable power rating is needed to influence the power of the first supply voltage because the power of all the other supply voltages is not influenced directly by the associated control stages. This enables very low overall losses and hence a very high overall efficiency to be attained. Moreover, the control system in accordance with the invention is suitable for a wide variety of uses because for controlling the first supply voltage only devices are added which influence the first nominal value of this first supply voltage, but which do not affect internal processes of this control system. Preferably, the circuit arrangement in accordance with the invention is used in conjunction with clocked power supplies, but it can also be used simply in conjunction with power supplies of other types.

In an advantageous embodiment of the circuit arrangement in accordance with the invention at least some of the further control stages are each individually coupled to the first control stage to vary the first nominal value. To change the first nominal value it is preferred to use a weighted combination of the control signals of these further control stages.

In this embodiment of the circuit arrangement in accordance with the invention said further control stages—at least some of all the further control stages—each influence the setting of the first nominal value without being influenced by the other further control stages. Thus, the control system in accordance with the invention can respond directly to variations of the individual supply voltages, for example, as a result of variations of the loads connected to these supply voltages. In conformity with the mutual influence between the supply voltages and the loads to be connected it is then preferred to form a weighted combination, for example a linear combination, of the control signals of the individual control stages, which combination can be used as a resultant control signal which determines the first nominal value.

In another embodiment of the invention at least some of the control stages are cascaded in such a manner that the control signal from each of the further control stages in the cascade arrangement is applied to a subsequent control stage in the cascade arrangement in order to vary the nominal value of this subsequent control stage within a range between the tolerance limits associated with this nominal value, a fixed nominal value being applied to the control stage at the beginning of the cascade arrangement.

This cascading of the control stages is another advantageous possibility for forming a resultant control signal. The cascade arrangement may again include all or only some of the further control stages. The cascade arrangement then acts directly upon the first nominal value. The control stage at the beginning of the cascade arrangement controls the actual value of the associated supply voltage to a fixed nominal value. The control signal supplied by this stage then controls the nominal value of the next control stage in the cascade arrangement in the described manner, which next control stage compares this adjustable nominal value with the actual value of the associated supply voltage to derive a control signal, which is applied to a third control stage in the cascade arrangement to control the nominal value of the supply voltage associated with this third control stage etc. Thus, in the same way as with the weighted combination of the control signals of the control stages, which each individually influence the first control stage, a resultant control signal is generated.

It is advantageous if the first control stage for controlling the actual value of the first supply voltage (Ua1) is arranged at the end of the cascade arrangement. The cascade arrangement then acts directly upon the first nominal value. However, it is also possible to combine one or more cascade arrangements and separate control stages which each act individually upon the first nominal value, in such a manner that, for example, a weighted combination of the resultant control signals of the cascade arrangements with the control signals of the individually operating control stages is employed for controlling the first nominal value. Moreover, such a (weighted) combination may also be provided at the beginning of a further cascade arrangement at whose end the first control stage is disposed. Owing to the various possibilities of combining, on the one hand, the cascade arrangement and, on the other hand, the (weighted) combination of the control signals or resultant control signals of individual cascade arrangements or a combination of these, which may also be referred to as a parallel arrangement of the control stages, many possibilities are obtained for varying the control characteristics and the weighting of the influences of the individual controllers on the first controller and, hence, the actual value of the first supply voltage.

BRIEF DESCRIPTION OF THE DRAWINGS

Embodiments of the invention will be described in more detail with reference to the accompanying drawings, in which like elements bear the same reference symbols. In the drawings.

DESCRIPTION OF THE PREFERRED EMBODIMENTS

Figure 1:
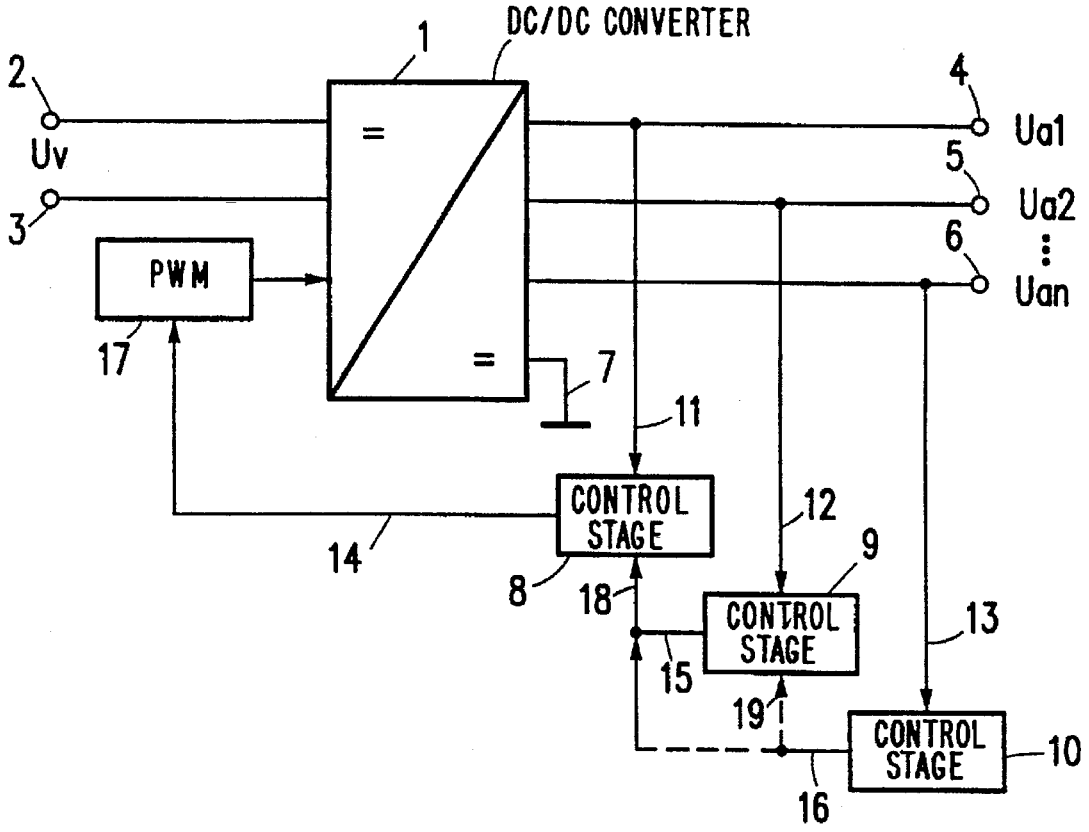
FIG. 1 is the block diagram of a first embodiment.

FIG. 1 shows the basic circuit diagram of an embodiment of the invention, in which the power supply is formed by a d.c./d.c. converter 1 of a type known per se, for example, a switched-mode power supply. An input voltage Uv is applied to input terminals 2, 3 of the d.c./d.c. converter 1. At its output the d.c./d.c. converter 1 has supply-voltage terminals 4, 5 and 6, at which mutually dependent supply voltages Ua1, Ua2, . . . . Uan are produced relative to a ground terminal 7 of the d.c./d.c. converter 1. The number of supply-voltage terminals 4 to 6 is arbitrary. For simplicity, only three supply-voltage terminals are shown in FIG. 1.

As already stated, the d.c./d.c. converter 1 may be constructed, for example, as a switched-mode power supply, which comprises a transformer with a number of secondary windings corresponding to the number of supply-voltage terminals 4 to 6, i.e. the number of interdependent supply voltages Ua1 to Uan. Each of the secondary windings is then preferably followed by a rectifier circuit which supplies the associated supply voltage. All of the supply voltages depend on one another via the transformer.

The circuit arrangement in FIG. 1 further comprises a first control stage 8, to which the first supply voltage Ua1 from the first supply-voltage terminal 4 of the d.c./d.c. converter 1 is applied via an actual value input 11. In the first control stage 8 the actual value of the first supply voltage U1a is compared with a first nominal value and this comparison results in a first control signal being applied to a control signal line 14. The control signal line 14 is connected to a pulse-width modulator 17. In this way the first control signal from the first control stage 8 controls the nominal value of the first supply voltage Ua1 via modulation of the switching pulses for the d.c./d.c. converter 1. Thus, the nominal value of the first supply voltage Ua1 can be controlled so as to be constant independently of the load connected to the supply-voltage terminal 4.

Since the other supply voltages Ua2 and Uan (and, if applicable, any further supply voltages, not shown) are dependent on the first supply voltage Ua1, their actual values are also influenced by the control of the actual value of the first supply voltage Ua1. However, this influence depends only on the load connected to the first supply-voltage terminal 4 but is not determined by the actual conditions for controlling the actual values of the supply voltages Ua2 to Uan. Without additional steps it is therefore possible that the actual value of the first supply voltage Ua1 is maintained very accurately at a given nominal value independent of the load but that the actual values of the further dependent supply voltages Ua2 to Uan deviate to a larger or smaller extent from a given nominal value for the relevant one of the further supply voltages Ua2 to Uan depending on the load of the first supply voltage Ua1 and on the load connected to this further supply voltage. If this deviation exceeds a given tolerance range dictated by the use of the circuit arrangement a satisfactory operation will no longer be guaranteed.

In order to overcome this problem by simple means, the circuit arrangement of the embodiment of the invention shown in FIG. 1 comprises a further control stage for each further dependent supply voltage Ua2 to Uan generated by the d.c./d.c. converter, i.e. a second control stage 9 and in the example shown in FIG. 1 an $n^{th}$ control stage 10. Each of these control stages 9, 10 has an actual value input 12 and 13, respectively, for receiving the actual value of the respective supply voltage Ua2 or Uan. In the same way as in the first control stage 8 each of the further control stages, i.e. the second control stage 9 and the $n^{th}$ control stage 10, compares the applied actual value and a further nominal value for the corresponding further supply voltage Ua2 or Uan, which nominal value is applied to the relevant control stage 9 or 10, in order to form a further control signal, which is available via an associated control signal line 15 or 16.

In accordance with the invention the control signals at the control signal lines 15, 16 are not used for directly influencing the associated supply voltages Ua2, Uan independently of the first supply voltage Ua1 but they change the first nominal value for the first control stage 8 in a manner such that, as a result of the adaptation of the nominal value of the first supply voltage Ua1, the dependent supply voltages Ua2, Uan also change in the desired manner and direction in response to this changed first nominal value. For this purpose, the first and the second control stage 8, 9 in the example shown in FIG. 1 (and any further dependent supply voltages, not shown, between Ua2 and Uan) each have a control input 18, 19, via which the nominal value for the associated control stage 8 or 9 can be changed. The connections between the control signal line 16 of the $n^{th}$ control stage 10 and the control inputs 18 and 19 of the first and the second control stage 8 and 9, respectively, are shown in broken lines because there are several possibilities for these connections within the scope of the invention.

In a first variant the control input 19 is connected to the control signal line 16 but there is no connection between the control signal line 16 and the control input 18. In the present case the three (and any further) control stages 8, 9, 10 form a cascade arrangement. The $n^{th}$ control stage 10, which always receives a fixed nominal value for the $n^{th}$ supply voltage Uan, produces a control signal at the control signal line 16 in accordance with the detected deviation between the actual value and the nominal value of this supply voltage Uan. By means of this control signal the nominal value for the second supply voltage Ua2, to be applied to the second control stage 9, can be adapted within given tolerance limits. This adaptation of the nominal value for the second supply voltage Ua2 can be effected so as to produce such a deviation between this nominal value and the detected actual value of the second supply voltage Ua2 that the resulting control signal at the control signal line 15 causes the first supply voltage Ua1 to be influenced so as to provide a desired correction of the $n^{th}$ supply voltage Uan in addition to a desired correction of the second supply voltage Ua2. Influencing of the first supply voltage Ua1 by the control signal from the second control stage 9 is then not effected directly but via the control input 18 of the first control stage 8, also by varying the nominal value, in the present case the first nominal value for the first supply voltage Ua1.

In another variant of the arrangement shown in FIG. 1 the control signal line 16 of the $n^{th}$ control stage 10 is not connected to the control input 19 but to the control input 18 of the first control stage 8, to which input the control signal line 15 of the second control stage 9 is also connected. The common connection of the control signal lines 15, 16 to the control input 18 can be achieved by addition of the control signals, but also by a weighted combination, for example, a linear combination. Weighting makes it possible, for example, to allow for different degrees of dependence of the individual supply voltages Ua2 and Uan on the first supply voltage Ua1. In this variant of FIG. 1, which is also referred to as a parallel arrangement of the further control stages 9, 10 (or their control signal lines 15, 16), each control signal or each further control stage 9 or 10 separately influences the first control stage 8 or the first nominal value of the first supply voltage Ua1 allocated to this stage.

In variants of the example shown in FIG. 1 having a larger number of supply-voltage terminals and control stages it is not only possible to extend the described cascade and parallel arrangements but also to combine the two types of arrangements of control stages.

Figure 2:
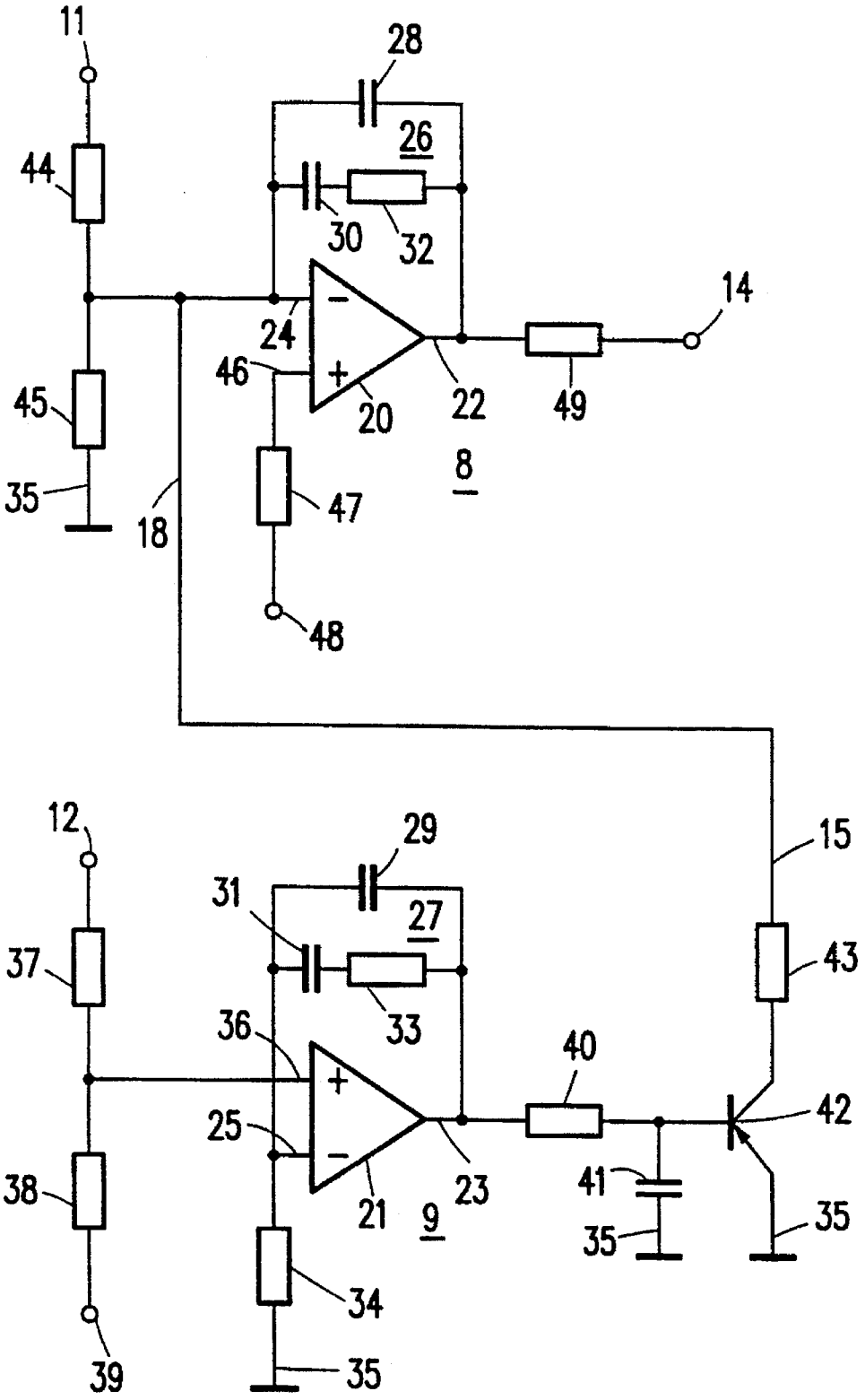
FIG. 2 is a detailed circuit diagram of a second embodiment.

FIG. 2 shows in detail an example of a cascade arrangement of two control stages, i.e. again the simplest case for the sake of clarity. Each of the two control stages 8, 9 comprises a respective operational amplifier 20 or 21, whose outputs 22 and 23, respectively, are connected to the respective inverting input 24 or 25 via a feedback network 26 or 27, respectively. Each feedback network 26, 27 comprises a first capacitance 28 or 29, respectively, arranged in parallel with the series arrangement of a second capacitance 30 or 31, respectively, and a resistor 32 or 33, respectively. It is also possible to use other feedback networks 26, 27 in order to modify the control characteristics of the control stages 8, 9.

Moreover, the inverting input 25 of the operational amplifier 21 in the second control stage 9 is connected to ground 35 via an input resistor 34. A non-inverting input 36 of the operational amplifier 21 in the second control stage 9 is connected to a node between two resistors 37, 38 forming a resistive voltage divider. The first resistor 37 of the voltage divider has its other end connected to the actual value input 12 of the second control stage 9 and the second resistor 38 has its other end connected to a reference voltage input 39. The resistors 37, 38 and the direct voltage applied to the reference voltage input 39 are dimensioned so as to provide the second nominal value of the supply voltage Ua2 for the second control stage 9, which second supply voltage is applied as the actual value to the actual value input 12 at the end of the voltage divider 37, 38 which is remote from the reference voltage input 39. The comparison between actual value and nominal value in the second control stage 9 results in a (second) control signal at the output 23 of the operational amplifier 21, which control signal is applied to a base terminal of a pnp transistor 42 via a low-pass filter comprising a series resistor 40 and a parallel capacitor 41 coupled to ground 35. This pnp transistor 42 has its emitter terminal connected to ground 35 and its collector terminal connected to one end of a resistor 43, whose other end is connected to the control signal line 15 of the second control stage 9. The control signal line 15 is connected to the control input 18 of the first control stage 8, which input is coupled to the inverting input 24 of the operational amplifier 20 and to a node between two resistors 44, 45 forming a further resistive voltage divider. The first resistor 44 of this divider has its other end connected to the actual value input 11 of the first control stage 8 and the second resistor 45 has its other end connected to ground 35. A non-inverting input 46 of the operational amplifier 20 is connected to a further reference voltage input 48 via a further input resistor 47. The output 22 of the operational amplifier 20 is connected to the control signal line 14 of the first control stage 8 via a further series resistor 49.

The signal produced at the output 23 of the operational amplifier 21 (after smoothing and low-pass filtering) as a result of the comparison between the actual value of the second supply voltage Ua2 at the actual value input 12 with the fixed nominal value for this supply voltage drives the pnp transistor 42 in such a manner that the resistor 43 in series with the forward resistance of the pnp transistor 42 is arranged in parallel with the second resistor 45 of the further voltage divider in the first control stage 8. As a result of this, the input voltage at the inverting input 24 of the operational amplifier 20 is changed in accordance with the control signal at the control signal line 15. This influences the comparison between the actual value of the first supply voltage Ua1 at the actual value input 11 with the first nominal value, which is determined not only by the further voltage divider 44, 45 and the resistor 43 but also by the further input resistor 47 and the further reference voltage at the further reference voltage input 48. In a variant of the arrangement shown in FIG. 2 the control input 18 may alternatively be connected to the non-inverting input 46, the further input resistor 47 and the further reference voltage input 48 in such a manner that, for example, via a voltage divider instead of the further input resistor 47, the influence of the reference voltage at the further reference voltage input 48 is changed by switching the resistor 43 into the circuit. Depending on the control signal from the second control stage 9 a different portion of the reference voltage at the further reference voltage input 48 is then applied to the non-inverting input 46 of the operational amplifier 20 of the first control stage 8. However, in both cases the operation is such that the second control stage 9 changes the (first) nominal value of the first control stage 8.

The circuit arrangement in FIG. 2 may be extended in that, for example, a further control stage is included between the control input 18 and the control signal line 15, which further control stage is of a construction similar to that of the first control stage 8 but which at its output comprises a resistor which can be switched into circuit via a transistor similarly to the pnp transistor 42 and the resistor 43. This resistor is then arranged in parallel with the second resistor 45 in the first control stage 8, whereas the control signal line 15 is connected to a control input similar to the control input 18. This provides a cascade arrangement of three control stages, which may be extended accordingly.

Alternatively, FIG. 2 may be extended in that an additional control stage similar to the second control stage 9 is also connected to the control input 18 with its control signal line. This additional control stage is then arranged in parallel with the second control stage 9. By a suitable dimensioning of the resistor 43 in the second control stage 9 and the corresponding resistor in the additional control stage it is possible to weight the influence of these control stages and, as a consequence, of the associated supply voltages on the first nominal value in the first control stage 8.

Figure 3:
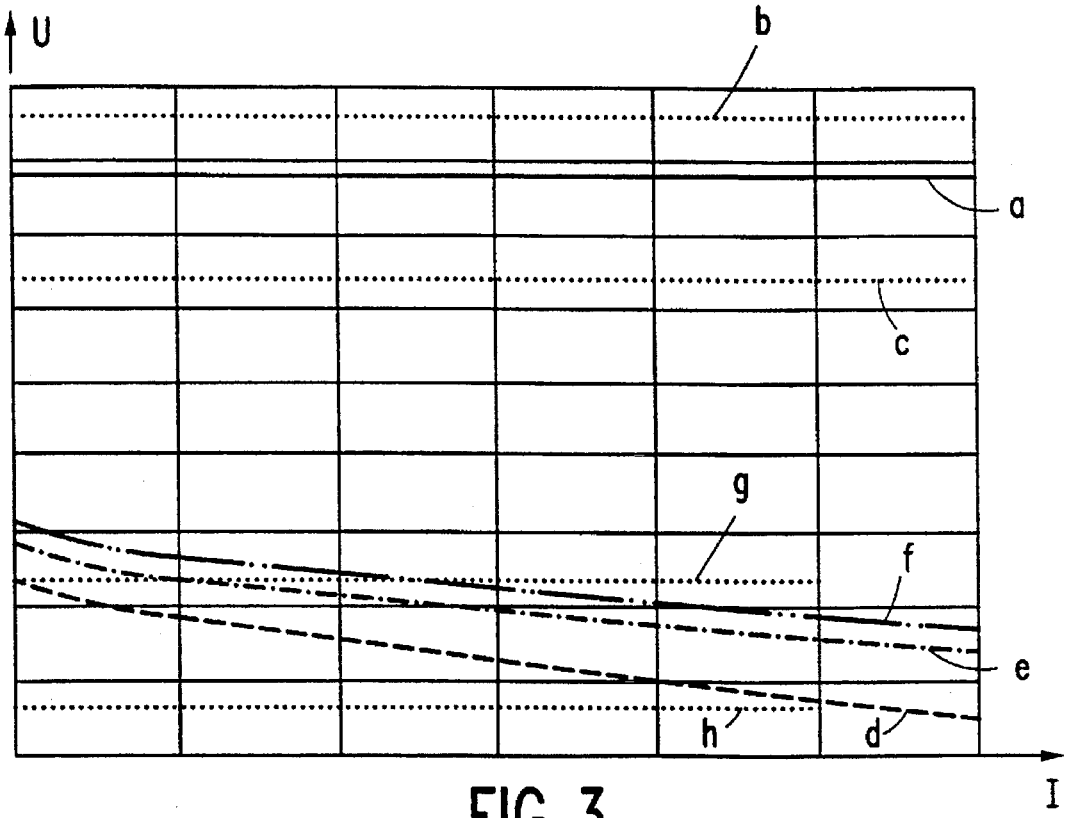
FIG. 3 is a current-voltage diagram of a power supply with two interdependent supply voltages, only one of which is controlled to a load-independent value.
Figure 4:
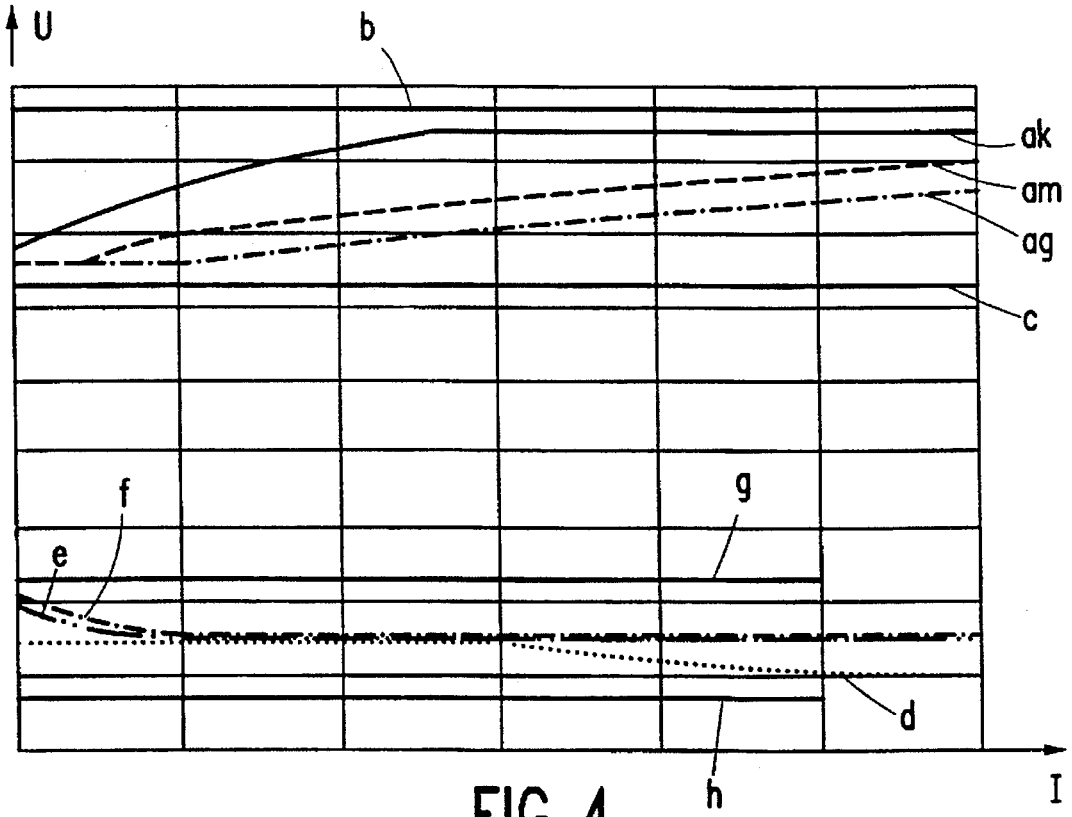
FIG. 4 is a current-voltage diagram of a power supply with two interdependent supply voltages, controlled in accordance with the invention.

By means of an example comprising two control stages, preferably as shown in FIG. 2, FIGS. 3 and 4 illustrate a comparison between an exclusive control of the first supply voltage and a second supply voltage (FIG. 3), which depends on and tracks this first supply voltage in a non-controlled manner, with a cascaded control in accordance with the invention as shown in FIG. 2 (represented in the diagram in FIG. 4). In FIGS. 3 and 4 the voltage U at the supply-voltage terminals (for example 4 and 5) is plotted along the vertical axis and the current I in these terminals is plotted along the horizontal axis. The solid line a in FIG. 3 represents the first supply voltage Ua1 in the case of a constant load current produced by this voltage, plotted versus the current in the corresponding current supply-voltage terminal. Since this first supply voltage is maintained at a constant load-independent value the curve a in FIG. 3 will be a horizontal line. The broken lines b and c, which represent the first upper (b) and the first lower (c) tolerance limit for the actual value of the first supply voltage, are shown for comparison. This shows that the first supply voltage Ua1 (curve a) in no way utilises the range between the tolerance limits b and c.

With the control method on which FIG. 3 is based the second supply voltage Ua2 is varied according to its dependence on the first supply voltage Ua1 in conformity with the load of the first supply voltage Ua1 and in conformity with the load of the second supply voltage Ua2 itself. Therefore, the second supply voltage Ua2 is plotted in FIG. 3 versus the load current produced by it for three different values of the load current produced by the first supply voltage Ua1. The dashed curve d represents the second supply voltage Ua2 for a small value of the load current produced by the first supply voltage Ua1, the dash-dot curve e represents the same for an average value of the load current of the first supply voltage Ua1, and the dash-dot-dot line f finally represents the same for a large value of the load current produced by the first supply voltage Ua1. Moreover, the second upper tolerance limit g and the second lower tolerance limit h are plotted for comparison. It will be seen that particularly for average and large loads of the first supply voltage the no-load value of the second supply voltage increases to such an extent that the upper second tolerance limit is exceeded.

FIG. 4 shows the corresponding voltage-current curves in the case of a cascaded control in accordance with the invention. The meaning of curves b to h in FIG. 4 is similar to that of the curves b to h in FIG. 3. In the same way as the curve a in FIG. 3 the curves ak, am and ag also represent the first supply voltage in dependence on the load current produced by the second supply voltage, i.e. for a small (curve ak), an average (curve am) and a large (curve ag) value of the load current produced by the first supply voltage. Whereas in FIG. 3, as a result of the control, the actual value of the first supply voltage (curve a) is independent of the current produced by the second supply voltage, this value is controlled depending on the load current for the second supply voltage Ua2 in the case of the cascaded control in accordance with the invention, as is shown in FIG. 4. This control differs for different loads of the first supply voltage, as is apparent from the curves ak, am and ag. However, the actual value for the first supply voltage remains within the given tolerance limits in accordance with the curves b and c for all load conditions of both the first supply voltage Ua1 and the second supply voltage Ua2. However, in the case of the control method in accordance with the invention the actual values for the second supply voltage Ua2 in accordance with the curves d, e and f also remain within the tolerance limits represented by the curves g and h. Thus, the fluctuations of the second supply voltage are limited to values within a permissible range at the expense of a permissible variation of the actual value of the first supply voltage.

I claim:

1. A circuit arrangement for generating at least two interdependent supply voltages from an input voltage, the arrangement comprising:

a first control stage for controlling the actual value of a first one of the supply voltages to a first nominal value which is adjustable between a first upper and a first lower tolerance limit, and at least one further control stage for controlling the actual value of each further one of the supply voltages to a further respective nominal value, which is adjustable within a range between each time a further upper and a further lower tolerance limit, by varying the first nominal value in the range between the first upper and the first lower tolerance limit in response to control signals obtained by a comparison between the actual values of the further supply voltages and the associated further nominal values in the associated control stages.

2. A circuit arrangement as claimed in claim 1, wherein at least some of the further control stages are each individually coupled to the first control stage so as to vary the first nominal value.

3. A circuit arrangement as claimed in claim 2, wherein a weighted combination of the control signals from at least some of the further control stages is utilised to vary the first nominal value.

4. A circuit arrangement as claimed in claim 1, further comprising means for coupling at least some of the control stages in cascade such that the control signal from each of the further control stages in the cascade arrangement is applied to a subsequent control stage in the cascade arrangement in order to vary the nominal value of the subsequent control stage within a range between the tolerance limits associated with this nominal value, a fixed nominal value being applied to the control stage at the beginning of the cascade arrangement.

5. A circuit arrangement as claimed in claim 4, wherein the first control stage for controlling the actual value of the first supply voltage is connected at the end of the cascade arrangement.

6. A power supply circuit for generating at least first and second interdependent supply voltages from an input voltage, comprising:

first and second input terminals for connection to a source of supply voltage for the circuit, at least first and second output terminals for supplying said at least first and second interdependent supply voltages, respectively, a voltage converter coupled between said input terminals and said output terminals, a first control stage having a first input coupled to receive a first voltage determined by the actual value of the supply voltage at said first output terminal and an output coupled to a control input of the voltage converter to supply the voltage converter with a first control signal to control the actual value of the first supply voltage at the first output terminal to a first nominal value that can vary in a range between a first upper limit voltage and a first lower limit voltage, a second control stage having an input coupled to receive a second voltage determined by the actual voltage of the supply voltage at said second output terminal and an output coupled to a further input of the first control stage to supply a second control signal thereto whereby the actual value of the second supply voltage at the second output terminal is controlled to a second respective nominal value variable within a voltage range between a second upper limit voltage and a second lower limit voltage by varying the first nominal voltage value in a range between the first upper limit voltage and the first lower limit voltage in response to the second control signal, wherein the second control stage includes means for comparing the second voltage with the second nominal value of the second supply voltage.

7. The power supply circuit as claimed in claim 6 further comprising:

a third output terminal for supplying a third interdependent supply voltage, a third control stage having an input responsive to a third voltage determined by the actual supply voltage at the third output terminal, and means for comparing said third voltage with a nominal voltage associated with the supply voltage at the third output terminal so as to derive a third control signal for controlling the voltage at the third output terminal, and means for individually coupling the third control signal to the further input of the first control stage which is responsive thereto so as to vary the first nominal voltage value within said first upper and lower limit voltage range and thereby vary at least the actual values of the voltages at the first and third output terminals within an acceptable voltage range.

8. The power supply circuit as claimed in claim 7 wherein the second control stage includes means for adjusting the nominal value of the supply voltage for the second output terminal as a function of the actual supply voltage at the second output terminal whereby the second control signal is adjusted to cause the first control stage to adjust the nominal value of the first supply voltage within said first upper and lower limit voltage range and to maintain the second actual supply voltage within an acceptable voltage range.

9. The power supply circuit as claimed in claim 6 wherein the second control stage includes means for adjusting the nominal value of the supply voltage for the second output terminal as a function of the actual supply voltage at the second output terminal whereby the second control signal is adjusted to cause the first control stage to adjust the nominal value of the first supply voltage within said first upper and lower limit voltage range and to maintain the second actual supply voltage within an acceptable voltage range approximate the nominal value of the second supply voltage.

10. The power supply circuit as claimed in claim 6 wherein said voltage converter comprises a DC/DC voltage converter, said power supply circuit further comprising:

a third output terminal for supplying a third interdependent supply voltage, a third control stage having an input responsive to a third voltage determined by the actual supply voltage at the third output terminal, and means for comparing said third voltage with a nominal voltage associated with the supply voltage at the third output terminal so as to derive a third control signal for controlling the voltage at the third output terminal, and means for coupling the third control signal to the further input of the first control stage which is responsive thereto so as to vary the first nominal voltage value within said first upper and lower limit voltage range and thereby vary at least the actual values of the voltages at the first and third output terminals within an acceptable voltage range.

11. The power supply circuit as claimed in claim 10 wherein said first, second and third control stages are connected in cascade whereby the third control signal is applied to an input of the second control stage to adjust the nominal value of the supply voltage for the second output terminal and the second control signal is applied to an input of the first control stage to adjust the nominal value of the supply voltage for the first output terminal within said first upper and lower limit voltage range.

12. The power supply circuit as claimed in claim 6 wherein the second control signal adjusts the nominal value of the first supply voltage in the first control stage such that for an increase of load current on the second output terminal the actual first and second supply voltages at the first and second output terminals are varied in an opposite direction.

13. The power supply circuit as claimed in claim 6 wherein the second control stage provides a continuous adjustment of the second control signal as the actual supply voltage at the second output terminal varies in a range of values about a second nominal value of the second supply voltage and within said voltage range between the second upper and lower limit voltages.

14. The power supply circuit as claimed in claim 6 wherein said first control stage further comprises:

second means for comparing said first voltage, a reference voltage determined by the first nominal value voltage, and said second control signal thereby to derive said first control signal.

* * * * *